United States Patent [19]

Kuramoto

[11] Patent Number: 4,728,874

[45] Date of Patent: Mar. 1, 1988

[54] METHOD FOR CONTROLLING INTERMITTENT OPERATIONS OF PROCESSING APPARATUS

[75] Inventor: Satoru Kuramoto, Hyogo, Japan

[73] Assignee: Mitsubishi Denki Kabushiki Kaisha, Tokyo, Japan

[21] Appl. No.: 864,220

[22] Filed: May 19, 1986

[30] Foreign Application Priority Data

May 20, 1985 [JP] Japan ..... 60-106113

[51] Int. Cl.[4] ..... G05B 19/25

[52] U.S. Cl. ..... 318/571; 318/39; 364/476; 364/478

[58] Field of Search ..... 318/571, 484, 39, 67, 318/77; 364/476, 474, 475, 478; 72/3, 28, 10, 14, 15, 20, 26, 421; 101/228, 235

[56] References Cited

U.S. PATENT DOCUMENTS 4,023,489 5/1977 Beery ..... 101/235
4,334,471 6/1982 Noyes ..... 101/228

FOREIGN PATENT DOCUMENTS 55-97808 7/1980 Japan .
1352878 5/1974 United Kingdom .
1398380 6/1975 United Kingdom .
2099187 12/1982 United Kingdom .

*Primary Examiner*—William M. Shoop, Jr.
*Assistant Examiner*—Patrick C. Keane
*Attorney, Agent, or Firm*—Bernard, Rothwell & Brown

[57] ABSTRACT

A method for realizing energy saving, for each of a plurality of mills provided in the hot rolling line, during the pause period until a successive work piece arrives a mill from a preceding work piece separates from a mill. The pause period is forecasted on the basis of a supply interval of work pieces supplied to the rolling line and a period of stay of work piece at each mill, and the mill is set in the pause state within the period defined by subtracting the preparation period required by the mill to reach the steady state from start of operation from such foreseen pause period.

4 Claims, 3 Drawing Figures

METHOD FOR CONTROLLING INTERMITTENT OPERATIONS OF PROCESSING APPARATUS

BACKGROUND OF THE INVENTION

1. Field of the Invention

The present invention relates to a method for controlling an apparatus which processes work pieces supplied intermittently and waits for the next processing during intervals between processings.

2. Description of Prior Art

An apparatus for processing work pieces supplied intermittently is so controlled, from the point of view of energy saving, that it operates at reduced energy levels in intervals between work pieces. FIG. 1 shows a system for controlling a rolling mill in the hot rolling line in such a manner that it operates at high energy levels only when a work piece is being rolled by the mill. Such system is disclosed in the Japanese Published Patent Application No. 55-147409. The continuous hot rolling line shown in FIG. 1 provides a rolling mill 7 consisting of a pair of rolls and this rolling mill serves for hot rolling of a work piece in accordance with well known procedures. Numeral 8 represents a preceding work piece which has already been processed as it passed through the rolling mill 7 and numeral 9 denotes a work piece which is newly supplied to the line for the hot rolling. The period between the supplying of a successive work piece 9 to the line and the supplying of the preceding work piece 8 to the line is defined as a supply pitch or an interval between processings and this interval can be adjusted.

A motor 6 for driving the rolling mill 7 receives power from a power supply (not shown) through a main switch 1 and a power converter 4. The motor 6 includes a field winding 6*a* and such winding is connected to the power supply through the switch 2 and the power converter 5. A cooling fan motor 12 connected to the power supply through the switch 3 is provided for cooling the motor 6.

The controller shown at reference numeral 10 controls the power converter 5 in accordance with the heading end and trailing end detection signal 11 of each work piece supplied from the rolling mill 7 so that the output of motor 6 is kept at the predetermined increased value during the rolling process of the work piece. The controller 10 also controls the power converters 4 and 5 during the period from the time when the preceding work piece 8 exits from the rolling mill 7 to the time when a successive work piece 9 arrives, so that the output of the motor 6 is suppressed either by decreasing the main circuit voltage 6*b* or by keeping the field current of the field winding 6*a* to a reduced value. While the output of the motor 6 is kept at this low level, power consumption of motor 6 is reduced as compared with continuous operation of the motor at its maximum output, and thus energy can be saved by this reduction of power consumption.

A problem of the conventional control described above is that the machine indicated as the rolling mill 7 in the example of FIG. 1 must always be kept at the reduced operating condition awaiting the arrival of the successive work piece during the interval between work pieces, and energy required for such waiting condition is consumed uselessly.

SUMMARY OF THE INVENTION

The present invention provides a method for realizing more effective energy saving by suspending operation of a processing apparatus for a work piece for a portion of the interval between successive processings of work pieces in those cases where the interval between the processing of a preceding work piece and the arrival of a succeeding work piece is remarkably long.

In one embodiment of the present invention, the method for controlling the apparatus for executing the predetermined processings to the work pieces supplied intermittently comprises the following steps of;

(a) accepting the data which indicates the supply interval of the work pieces;

(b) foreseeing an estimated period of pause between exit of a work piece from the apparatus and arrival of the succeeding work piece to the appratus on the basis of a value which indicates a difference between the supply interval and a predetermined period of stay of the work piece at the apparatus;

(c) executing an arithmetic operation by substracting from the estimated period of pause a value corresponding to a predetermined preparation time required to reach steady operation after starting the appratus from a stopped condition; and (d) separating said apparatus from a driving source for the period corresponding to the remainder of the subtraction operation of step (c) only when such remainder in step (c) is larger than a predetermined value.

A practical example of the apparatus for processing the work pieces is a mill provided in the hot roll line.

DETAILED DESCRIPTION OF THE PREFERRED EMBODIMENT

Figure 2:
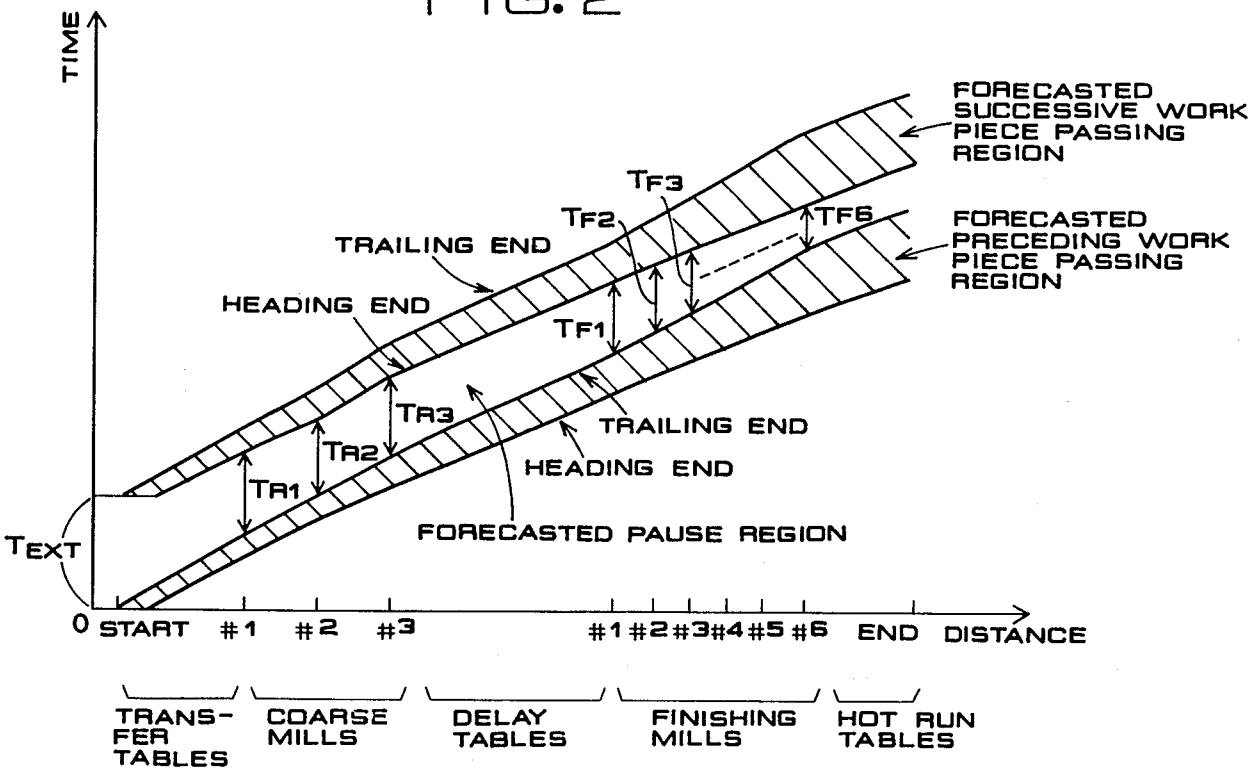
FIG. 2 is a graph indicating the running time of apparatus in such a case that the method of the present invention is adapted to the system shown in FIG. 1.

FIG. 2 shows a graph of the running time of respective elements required for specified processings in such a case that the work piece sequentially shifts various elements of hot rolling line where the control method of the present invention is adopted. This hot rolling line includes a transfer table group, a rough milling group, a delay table group, a finish mill group and a hot line table group, and the heading end of this line is connected to the exit of the furnace for heating work pieces while the trailing end is connected to the winder which winds up the rolled product, namely the strip. The control method of the present invention can be adapted to all components of the hot rolling line but the maximum economical effect can be obtained when it is adapted to a rolling mill which shows very large consumption of energy.

Figure 1:
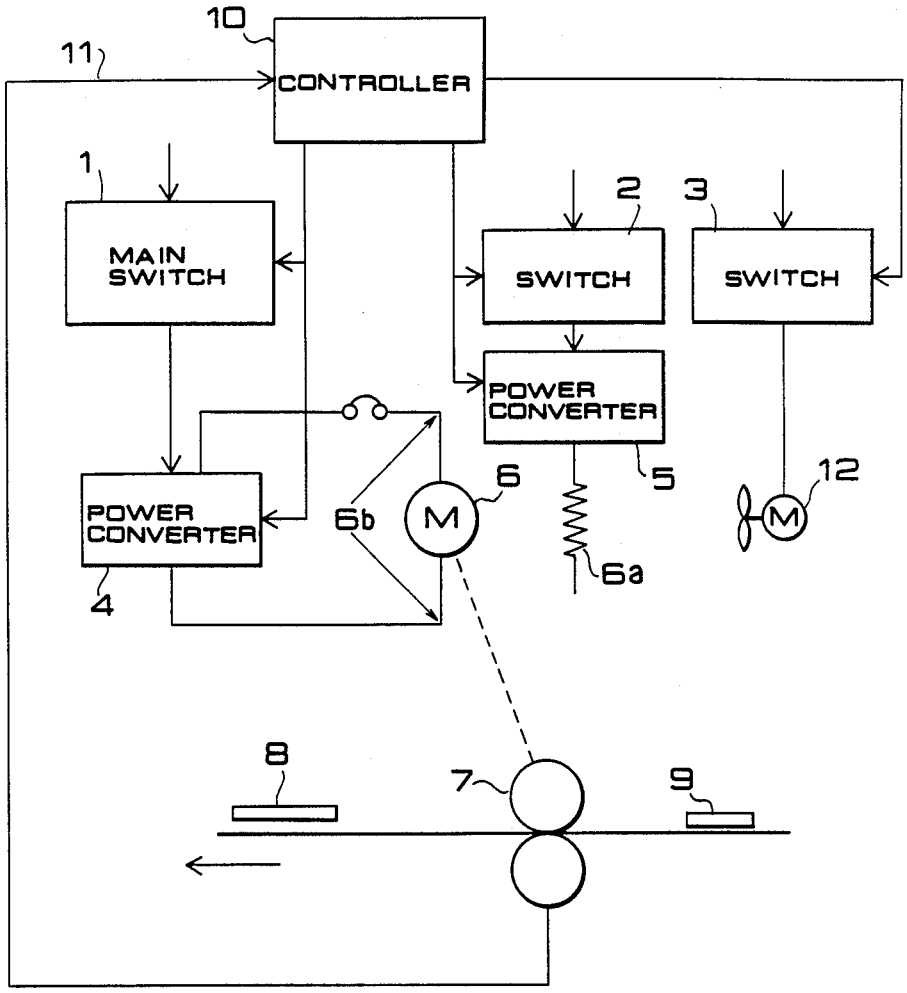
FIG. 1 (PRIOR ART)
FIG. 1 is a block diagram indicating a conventional system for controlling a motor which drives a rolling mill.

In the typical application example, the control method of the present invention is adapted to a rolling mill 7 shown in FIG. 1. In the practical application of the method of the present invention, only the controller 10 requires modification. Since the controller 10 is desired to have various functions including the control of the switches 1, 2, and 3, it is desirably replaced with a microcomputer.

FIG. 2 shows relative positions of the work pieces supplied one by one to the line from the heating furnace with a predetermined interval $T_{EXT}$ between work pieces in a typical hot rolling line comprising three coarse mills and six finishing mills. A preceding work piece having a certain length is elongated by the rolling process each time the work piece passes a mill. Therefore, the time required for passing a particular position or the period of stay of each work piece at each mill on the line becomes longer each time the work piece passes the mill. Thereby, the width in a time axis direction of the foreseen passing region of preceding work piece becomes wider with time, as indicated as the hatched region in FIG. 2. After the period corresponding to the predetermined interval $T_{EXT}$ from supply of preceding work piece to the line, the succeeding work piece is supplied to the line, forming a forecasted succeeding passing region. In the region between two adjacent forecasted passing regions, that is, within the period from passing of the trailing end of a preceding work piece to arrival of the leading end of the succeeding work piece, each mill and table may be set in the pause condition. This time region is called the forecasted pause region. It is natural that the width in the time axis direction of this forecasted pause region is maximum at the heading end of the line and gradually becomes smaller for each mill that the work piece passes. The widths of forecasted pause regions of coarse mills #1, #2, #3 are indicated as $T_{R1}$, $T_{R2}$, $T_{R3}$ and those of finishing mills #1~#6 are indicated as $T_{F1}$–$T_{F6}$.

Theoretically, the coarse mill #1 may be in the pause state within the period indicated by $T_{R1}$. However, the coarse mill requires a predetermined time until it reaches the steady operating condition from turning ON of the power supply of motor which is used as the driving source, as the general characteristic of a machine having a large mass of the movable portion. The time required until the motor reaches the steady condition from the start is called $T_{ER}$. The practical value of this preparation time $T_{ER}$ is usually different for the different mills and therefore the preparation times of coarse mills #1–#3 are sometimes indicated as $T_{ER1}$–$T_{ER3}$, while the preparation times of finishing mills #1–#6 as $T_{EF1}$–$T_{EF6}$. Since electrical control of the starting time of each mill is carried out depending on the predetermined sequence, the preparation time of each mill is defined by a known constant value.

In the present invention, the time required for a work piece to pass each mill is incorporated to each mill. In general, it means the time between engagement of the contact of the leading end of work piece with the guide which is hydraulically driven, and the time the trailing end of the work piece separates from the guide, namely the actual running time for each work piece. Since the length of work piece is elongated with advancement of the rolling process, the actual running time of each successive mill is longer as shown in FIG. 2 while the work piece advances toward the downstream side of the rolling line. It means that when the work piece supply interval $T_{EXT}$ is constant, the interval between the actual running time, namely the interval between the foreseen passing region for the preceding work piece and the foreseen passing region for the succeeding work piece becomes sequentially shorter in the downstream direction. The value of the interval $T_{EXT}$ is set so that the value of interval $T_{F6}$ at the finishing mill #6 located at the most downstream area does not become negative.

The controller 10 forecasts the pause time of each mill $T_{R1}$–$T_{R3}$ and $T_{F1}$–$T_{F6}$ based on the externally supplied interval $T_{EXT}$ and a preset value concerning the passing time of work piece, executes the arithmetic operation for subtracting the preparation time from the foreseen pause time and also executes the control for continuing or suspending the operation of each mill on the basis of such arithmetic operation.

Figure 3:
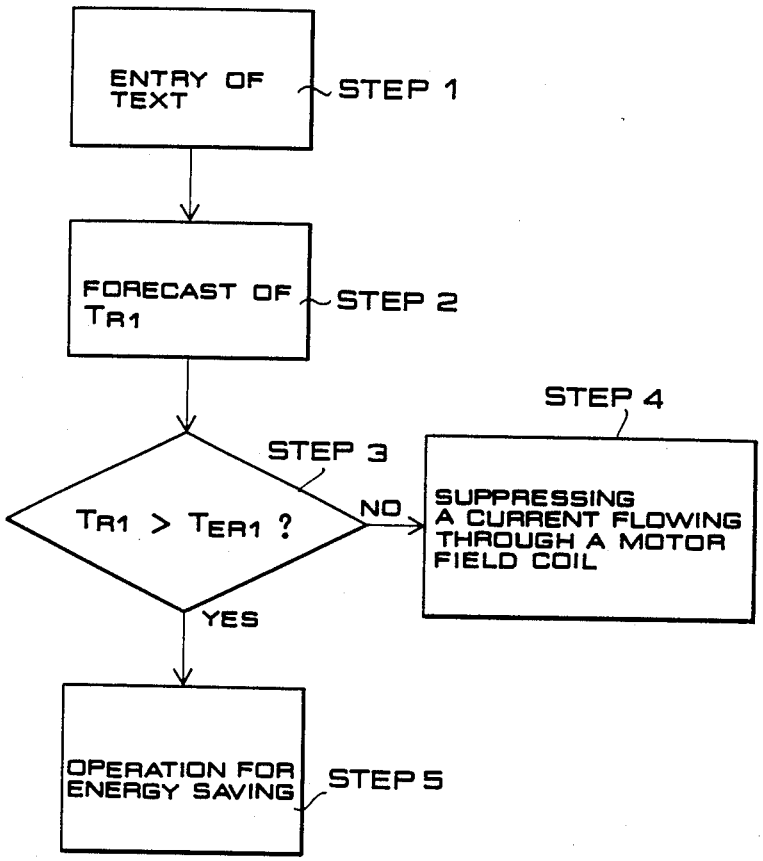
FIG. 3 is a flow chart indicating control operation flow by the controller.

The control procedures of the controller for the coarse mill #1 are explained with reference to the flow chart of FIG. 3. In the step 1, the data indicating the supply interval $T_{EXT}$ of work piece supplied from the apparatus which controls the entire part of the hot rolling system is read. In the step 2, the arithmetic operation which determines the foreseen pause time $T_{R1}$ is carried out based on the value of $T_{EXT}$ entered in the step 1 and the preset foreseen passing time of work piece. Since the length of work piece supplied is equal to the length of work piece supplied to the line in the coarse mill #1, $T_{R1}$ can be obtained by subtracting the time required for the work piece to pass through the coarse mill #1 from $T_{EXT}$. In each successive mill, the length of work piece output from the mills in the upstream side is used as the parameter.

Comparison between the estimated value of $TR_1$ and the preset preparation time $T_{ER1}$ is carried out in the step 3. Result of comparison is given in the form of $T_{R1} > T_{ER1}$ or not. If NO, a field current flowing through the field coil 6a is controlled to a predetermined value or suppressed (step 4). When result of comparison is YES, energy saving operation is carried out in accordance with the predetermined sequence (step 5). The operation for energy saving includes that the switches 1, 2, 3 are turned OFF after the trailing end of work piece separates from the mill 7 and the motor 6 and the fan motor 12 stop. The period where switches are kept OFF corresponds to a value, $T_{R1}$–$T_{ER1}$. When this period has expired, the controller 10 controls the switches 1, 2, 3 and the power converters 4 and 5 and starts the mill 7 with the motor 6, following the predetermined start sequence. After the predetermined preparation period $T_{ER1}$, the mill 7 enters the steady operating condition and is ready for arrival of a successive work piece.

As is obvious in above description with reference to FIG. 2, the foreseen pause time is longer as the length of work piece is shorter. Therefore, if the preparation period at the time of starting the operation for each mill is equal, the most distinctive energy saving effect can be obtained in case the method of the present invention is adapted to the mill located most upstream of the rolling line. The present invention comprehends the control for only the most upstream mill, control for selected several mills and control for all mills. If it is desirable, the present invention can also be adapted to other apparatus such as the transfer table, etc.

Above explanation is developed for utilization of the method of the present invention to a hot rolling line including a plurality of mills. However, the method of the present invention can also be adapted, as is obvious from above explanation, to all intermittent operation systems to which the work pieces are supplied intermittently.

What is claimed is:

1. A method for controlling an apparatus which processes work pieces supplied intermittently comprising the steps of:

(a) accepting data indicating a supply interval between supplying of successive work pieces, (b) forecasting a foreseen pause time between separation of a preceding work piece from the apparatus and the arrival of a succeeding work piece at the apparatus based on a value which indicates a difference between said supply interval and a predetermined period of stay of each work piece at the apparatus, (c) executing an arithmetic operation for subtracting from said foreseen pause time a value corresponding to a predetermined preparation time required for the apparatus until it reaches a steady state from the start of operation, and (d) separating said apparatus from a driving source for a time corresponding to the remainder calculated in step (c) only when the foreseen pause time exceeds said preparation time.

2. A method for controlling at least one of a plurality of mills provided in a hot rolling line for rolling work pieces supplied intermittently comprising the steps of:

(a) accepting data which indicates a supply interval between supplying of successive work pieces to said line, (b) forecasting a foreseen pause time between separation of a preceding work piece from the one mill and the arrival of a succeeding work piece at the one mill based on a value which indicates a difference between said supply interval and a predetermined period of stay of each work piece at the one mill, (c) executing an arithmetic operation for subtracting from said foreseen pause time a predetermined preparation time required for the one mill until it reaches a steady state from start thereof, and (d) suspending operation of a driving source of said one mill, only when the value obtained by the arithmetic operation in the step (c) is larger than a predetermined value, for a period corresponding to said remainder obtained from the arithmetic operation in the step (c).

3. A method according to claim 2, wherein the driving source of said mill provides electrical power for a motor having a field winding and said motor is separated from the electrical power during said step of suspending operation.

4. A method according to claim 3, wherein a field current supplied to said field winding is controlled to a predetermined value in case said foreseen pause time is shorter than said predetermined preparation time.

* * * * *